US008684478B2

(12) United States Patent
Park et al.

(10) Patent No.: US 8,684,478 B2
(45) Date of Patent: Apr. 1, 2014

(54) FOOD CONTAINER AND REFRIGERATOR INCLUDING THE SAME

(75) Inventors: Kyu Tae Park, Seoul (KR); Hong Sik Kwon, Seoul (KR); Kyeong Chul Cho, Seoul (KR); Seon Il Yu, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/521,194

(22) PCT Filed: Jan. 13, 2011

(86) PCT No.: PCT/KR2011/000259
§ 371 (c)(1),
(2), (4) Date: Jul. 9, 2012

(87) PCT Pub. No.: WO2011/087302
PCT Pub. Date: Jul. 21, 2011

(65) Prior Publication Data

US 2013/0127321 A1 May 23, 2013

(30) Foreign Application Priority Data

Jan. 15, 2010 (KR) ..... 10-2010-0003696
Jan. 15, 2010 (KR) ..... 10-2010-0003697

(51) Int. Cl.
*A47B 96/04* (2006.01)

(52) U.S. Cl.
USPC ..... 312/404

(58) Field of Classification Search
USPC ..... 312/402, 404; 206/549; 220/318, 324, 220/326, 759, 762, 784; 62/457.1, 457.2, 62/457.7
See application file for complete search history.

(56) References Cited

U.S. PATENT DOCUMENTS

| | | | | | |
|---|---|---|---|---|---|
| 1,199,680 | A | * | 9/1916 | Fabian | 220/764 |
| 4,759,478 | A | * | 7/1988 | Richardson et al. | 222/556 |
| RE32,740 | E | * | 8/1988 | Steffes | 312/351 |
| 5,064,088 | A | * | 11/1991 | Steffes | 220/837 |
| 5,337,911 | A | * | 8/1994 | Holub | 220/254.3 |
| 5,641,065 | A | * | 6/1997 | Owens et al. | 206/370 |
| 6,119,679 | A | * | 9/2000 | Galvin | 126/41 R |
| 6,273,288 | B1 | * | 8/2001 | Jarvis | 220/254.3 |
| RE37,518 | E | * | 1/2002 | Hardigg et al. | 16/438 |
| 2004/0031705 | A1 | | 2/2004 | DeTemple, II et al. | |
| 2005/0006390 | A1 | * | 1/2005 | Wang | 220/326 |
| 2006/0112721 | A1 | * | 6/2006 | Kang | 62/440 |
| 2008/0314067 | A1 | * | 12/2008 | Lee | 62/441 |

FOREIGN PATENT DOCUMENTS

| | | |
|---|---|---|
| AU | 645008 | 1/1994 |
| DE | 20 2005 020 035 U1 | 3/2006 |
| KR | 10-2004-0018077 A | 3/2004 |

* cited by examiner

*Primary Examiner* — Matthew Ing
(74) *Attorney, Agent, or Firm* — Birch, Stewart, Kolasch & Birch, LLP

(57) ABSTRACT

A food container and a refrigerator including a food container capable of simultaneously separating fixing members of a cover according to sliding of a handle and of taking out of food kept therein by opening an auxiliary cover even with a main cover being closed. The food container includes a main body having an entrance formed on a topside thereof, a cover opening and closing the entrance, a plurality of fixing members including one end rotatably secured to a side surface of the main body and the other end detachably connected with an edge part of the cover, to secure the cover to the main body selectively, and a handle sliding-movable on a top surface of the cover and contactable with the plurality of the fixing members, to push the plurality of the fixing members according to the sliding to unlock the securing between the cover and the main body.

16 Claims, 15 Drawing Sheets

FOOD CONTAINER AND REFRIGERATOR INCLUDING THE SAME

TECHNICAL FIELD

The present invention relates to a food container for storing food stuffs and a refrigerator including the same, more particularly, to a food container capable of simultaneously separating fixing members of a cover according to sliding of a handle and of taking out of food kept therein by opening an auxiliary cover even in a state of a main cover being closed, only to be usable conveniently, and a refrigerator including the food container.

BACKGROUND ART

In general, food stuffs are contained and kept in a variety of containers including dishes and baskets.

To preserve food stuffs for a relatively long time, the food stuffs are contained in containers, with covers being closed, and the food stuffs contained in the containers are frozen or refrigerated in a refrigerator in a state of being closed airtight.

Especially, a relatively large container is used in Kimchi refrigerator to ripen Kimchi for a required period.

Such a food container for storing food stuffs includes a container main body having an open top, a cover for closing the open top and securing means for securing the cover to the container main body. In case of a relatively large food container, it is inconvenient to lift and move the food container having food stuffs therein and then a handle may be further provided in the relatively large food container.

In recent, a variety of plastic food containers have been under development and a securing member hingedly connected with the cover or main body of the food container to secure the cover to the main body airtight may be used as securing means.

However, in case of the food container including four securing members provided in four sides thereof, a user has to separate four securing members one by one with his or her hands to open the cover and to take out food. Especially, in case of the Kimchi container, the user has to take out the heavy Kimchi container out of the refrigerator even to take out a small amount of Kimchi. After that, he or she has to unlock the plurality of the securing members one by one manually to open the cover disadvantageously and inconveniently.

In the meanwhile, a variety of food stuffs may be frozen or refrigerated in a storage chamber of the refrigerator. When keeping them in the refrigerator, food stuffs may be put on a shelf provided in the storage chamber or in a storage compartment detachably installed in the storage chamber.

The food stuffs may be contained and stored in auxiliary containers and such an auxiliary container may have a size and an appearance corresponding to the size and appearance of a storage space provided in the shelf or the storage compartment of the refrigerator.

Especially, Kimchi refrigerators structured to ripen and preserve Kimchi and the like for a relatively long period have been fabricated, with Kimchi containers provided therein.

Such a Kimchi container used in a Kimchi refrigerator has a high water content and relatively heavy food may be stored in the Kimchi container. To take Kimchi out of such the container, the user opens a refrigerator door and takes out the container. After that, the user has to open a cover of the Kimchi container and he or she take out kimchi to contain it in a dish. Then, the user has to close the cover and put the container back to the refrigerator and then he or she has to close the refrigerator door.

DISCLOSURE OF INVENTION

Technical Problem

As mentioned above, it is hard and inconvenient to use such the food container. Because of that, demands for developing a food container used conveniently have been increasing.

Solution to Problem

Accordingly, the present invention is directed to a food container and a refrigerator including the same.

An object of the present invention is to provide a food container having a plurality of securing members separable simultaneously by a uses sliding of a handle provided therein.

Another object of the present invention is to provide a food container capable of allowing the user to open an auxiliary cover to take out food even in a state of a main cover being closed, and a refrigerator including the food container.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings. To achieve these objects and other advantages and in accordance with the purpose of the invention, as embodied and broadly described herein, a food container includes a main body having an entrance formed on a topside thereof; a cover opening and closing the entrance of the main body; a plurality of securing members comprising ends rotatably secured to a side surface of the main body and the other ends detachably connected with an edge part of the cover, to secure the cover to the main body selectively; and a handle sliding-movable on a top surface of the cover and contactable with the plurality of the securing members, to push the plurality of the securing members according to the sliding to unlock the securing between the cover and the main body.

A rotation shaft of the handle may be coupled to a long-hole-shaped shaft hole rotatably and slidingly in a right-and-left direction, the shaft hole formed in parallel to a top surface of the cover.

The handle may include a plurality of projecting parts provided in side surfaces thereof to push the plurality of the securing members connected to the cover according to outward movement to separate the plurality of the securing members from the cover.

The plurality of the securing members may include a plurality of projections formed at upper edges thereof to be pushed by the projecting parts of the handle, respectively.

The size of the shaft hole may be getting larger toward a center of the cover gradually.

The cover may be configured of a rectangle having two first-sides and two second-sides and the plurality of the securing members may include a pair of securing members coupled to first side edges of the cover and a pair of securing members coupled to second side edges of the cover, and a slope surface may be formed in a predetermined portion of each projection of the pair of the securing members coupled to the second side edge part of the cover, the slope surface formed in the portion contacting with the projecting part of the handle.

A lower end edge part of the securing member may be more extended downward than a hinge shaft of the securing member.

The food container may further include an opening formed in a center of the cover; and an auxiliary cover opening and closing the opening of the cover.

The auxiliary cover may be rotatably coupled to a predetermined portion of the opening by a hinge.

The auxiliary cover may include a slope surface formed in an outer surface of the portion having the hinge connected thereto.

The slope surface of the auxiliary cover may form an angle of 100°~110° with respect to a top surface of the auxiliary cover.

A projecting part may be formed projected upward from an edge part of the opening, and a groove may be formed in an edge part of the auxiliary cover to insert the projecting part therein, when the auxiliary cover is closed.

The auxiliary cover may be formed of transparent material.

The auxiliary cover may further include a handle part provided in an opposite edge part of the auxiliary cover to the hinge.

In another aspect of the present invention, a refrigerator includes a cabinet comprising a storage chamber formed therein; a door opening and closing a front surface of the cabinet; a drawer compartment retractably provided in the cabinet; and a food container detachably installed in the storage chamber or the drawer compartment, the food container comprising a main body having an entrance formed on a topside; a cover opening and closing the entrance of the main body, with an opening formed in a center thereof; a securing member securing the cover to the main body; and an auxiliary cover rotatably coupled to a rear portion of the opening of the cover 30 to open and close the opening.

The plurality of the securing members may be provided, with ends rotatably secured to a side surface of the main body and the other ends detachably connected with an edge part of the cover to secure the cover to the main body.

The food container may further include a pair of handles movably provided on a top surface of the cover; and a plurality of projecting parts provided in side surfaces of the handles to push the plurality of the securing members connected to the cover according to outward movement of the handles to separate the securing members.

A hinge of the auxiliary cover provided in the food container may be located in front of a front surface of a door beyond the drawer compartment, when the auxiliary cover of the food container is opened at a maximum angle after the drawer compartment is moved outward, and an upper edge of the auxiliary cover may be not in contact with the front surface of the door when the auxiliary cover is opened.

Advantageous Effects of Invention

The food container according to the present invention has following advantages.

First, the user is sliding the handle provided in the cover of the food container. Because of that, the plurality of the securing members may be separated from the cover simultaneously and the cover may be separated from the main body smoothly.

Second, when the user lifting the food container, with holding the handle, the rotation shaft of the handle may be moved naturally. As a result, the cover may be prevented from opening because the securing members are separated by the handle.

Third, the securing members are configured not to be distant from the side surface of the main body at a predetermined angle or more. As a result, the user opens the cover to take out food, even when the food container is placed in the refrigerator. Together with that, the required space of the storage chamber provided in the refrigerator may be minimized.

Fourth, the auxiliary cover is provided in the cover of the food container. As a result, even in a state of the cover being closed, the auxiliary cover is opened and food is taken out to allow the user use the food container conveniently.

Fifth, the projecting part and the groove are coupled between the cover and the auxiliary cover. As a result, cold air may be prevented from leaking via the auxiliary cover.

Sixth, the auxiliary cover is formed of transparent material. As a result, the condition of food stored in the food container may be identified, even with the cover and the auxiliary cover being closed.

Last, when the food container is installed in the refrigerator, the rotational angle of the auxiliary cover is limited. As a result, the auxiliary cover may not interfere with the door of the refrigerator and the other components.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

As follows, a food container according to an exemplary embodiment will be described in reference to the accompanying drawings.

Figure 1:
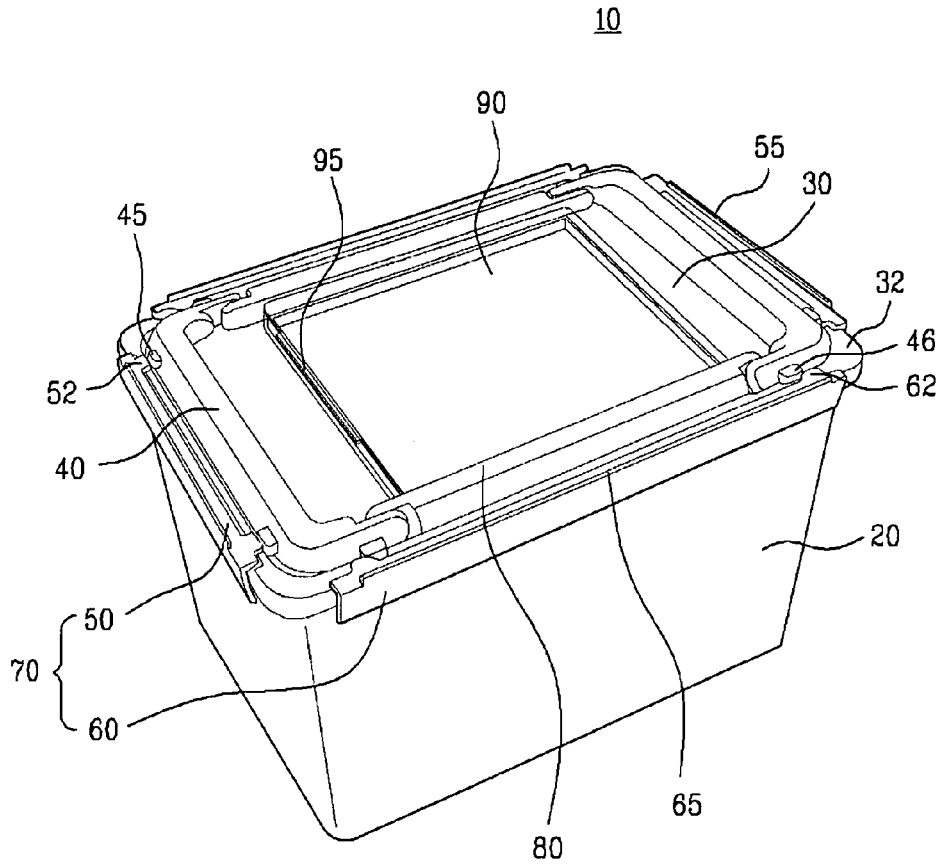
FIG. 1 is a perspective view illustrating an exterior appearance of a food container according to an exemplary embodiment of the present invention.
Figure 2:
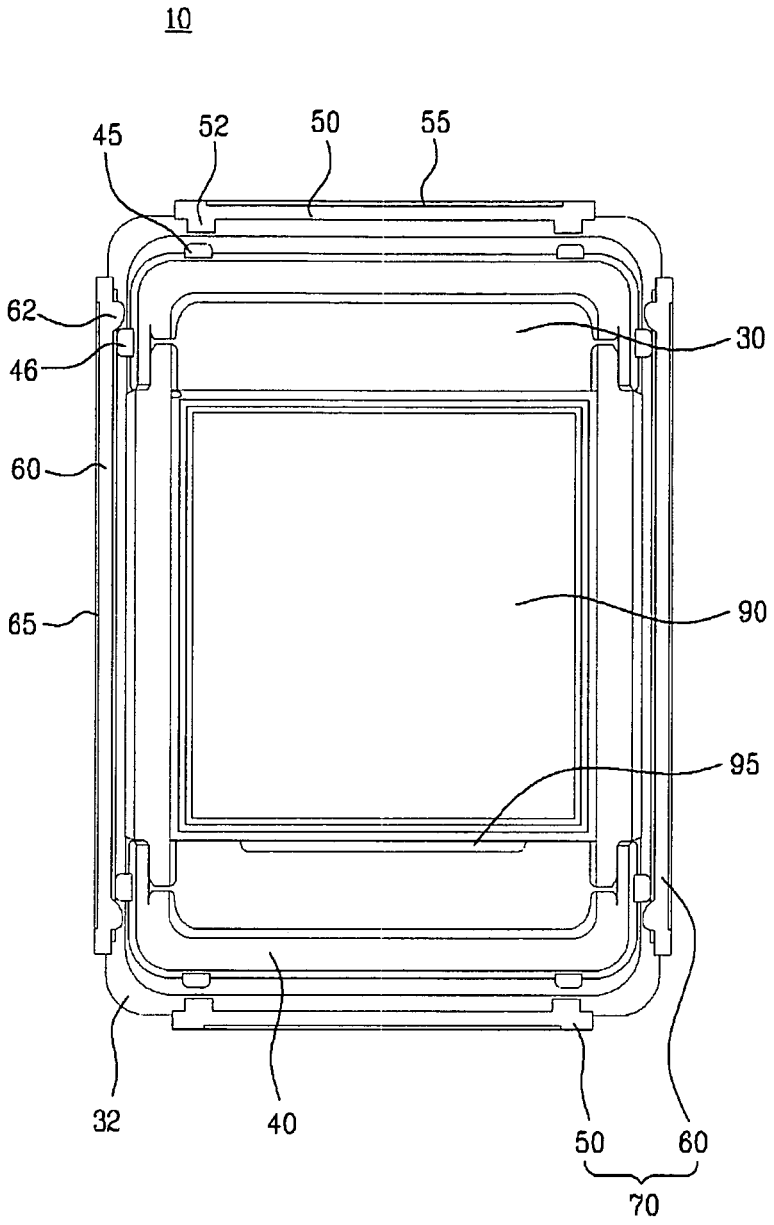
FIG. 2 is a plane view of the food container shown in FIG. 1.
Figure 3:
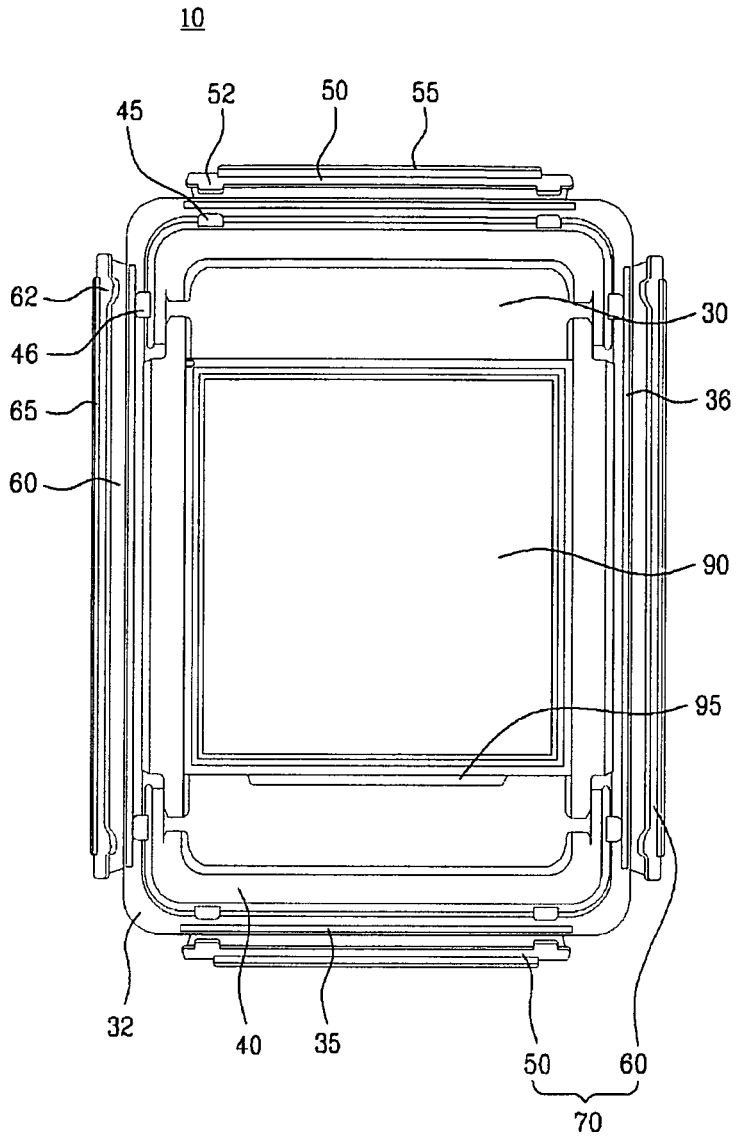
FIG. 3 is a plane view illustrating a plurality of securing members which are separated from the food container shown in FIG. 2, see above.

FIG. 1 is a perspective view illustrating an exterior appearance of a food container according to an exemplary embodiment of the present invention. FIG. 2 is a plane view of the food container shown in FIG. 1. FIG. 3 is a plane view illustrating a plurality of securing members which are separated from the food container shown in FIG. 2, see above.

A food container 10 according to this embodiment of the present invention includes a main body 20 having a food entrance formed on a topside, a cover 30 for closing the food entrance of the main body 20 and a plurality of securing members 70 having ends rotatably secured to sides of the main body 20 and the other ends detachably connected to a edge part 32 of the cover 30, to secure the cover 30 to the main body 20.

The main body 20 of the food container 10 is formed in a hexahedral shape with an open top. Here, corners of the hexahedron may be curved to be connected with each other.

The cover 30 is selectively connected to the open top of the main body and it opens and closes the entrance. The cover 30 may be connectedly secured to the main body 20 by the plurality of the securing members 70 rotatably coupled to side upper ends of the main body 20.

The plurality of the securing members 70 include a pair of first side securing members 50 and a pair of second side securing members 60. The pair of the first side securing members 50 and the pair of the second side securing members 60 are facing each other.

The plurality of the securing members 50 and 60 may have a sectional area formed in '¬' shape.

Handle parts 55 and 65 are projected upwardly from top surfaces of the securing members 50 and 60, respectively. Because of that, the user may rotate and open each of the securing members 50 and 60, with holding each of the handle parts 55 and 65.

A pair of sliding-movable handles 40 may be installed in a top surface of the cover 30.

This pair of the handles 40 may be sliding horizontally on the top surface of the cover 30 in a predetermined range, with being rotatably installed thereto.

A pair of handle coupling ribs 80 may be formed adjacent to the second side corners of the cover 30 to couple the handles 40 to the top surface of the cover 30, with being opposed to each other.

The handles 40 may be formed in '⊏'-shape and inner end surfaces of the handles 40 are coupled to outer end surfaces of the handle coupling ribs 80, respectively.

A long-hole-shaped shaft hole 84 is formed in an outer end surface of each handle coupling rib 80, in parallel to the top surface of the cover 30. A rotation shaft 48 projected from the inner end surface of each handle 40 is slidingly and rotatably coupled to the shaft hole 84.

The structure of the handles 40 coupled to the pair of the handle coupling ribs 80 and the operation thereof will be in detail later.

A plurality of projecting parts 45 may be formed in sides of the handles 40 toward the first sides to push upper portions of the first side securing members 50 when the handles 40 are sliding toward the first sides. A plurality of projected parts 46 may be formed even in sides of the handles toward the second sides to push the second side securing members 60 when the handles 40 are sliding toward the first sides.

A plurality of projections 52 projected sideward to face the projected parts 45 of the handles 40 may be formed in upper surfaces of the first side securing members 50. The projections 52 are spaced apart a predetermined distance from the projecting parts 45 of the handles 40 and they are pushed by the projected parts 45, respectively, when the handles 40 are sliding.

A plurality of projections 62 projected sideward may be formed in upper surfaces of the second side securing members 50 to be pushed by the projections 46 of the handles 40. The movement direction of the projected parts 46 formed in the handles 40 is perpendicular to the movement direction of the projections 62 formed in the second side securing members 60. Because of that, the projections 62 of the second side securing members 60 have slope surfaces in contact with the projections 46 of the handles 40.

As a result, when the user is sliding the handles outwardly, the plurality of the securing members 50 and 60 secured to the cover 30 may be pushed simultaneously, to unlock the secured state of the securing members 50 and 60 simultaneously as shown in FIG. 3.

In the meanwhile, a rectangular-shaped opening (38, see FIG. 12) is formed in a center of the cover 30 and an auxiliary cover 90 for closing the opening 38 may be connected with a hinge (91, see FIG. 12) formed in a predetermined portion near the opening. A handle 95 is formed in an opposite corner to the hinge of the auxiliary cover 90. Because of that, the user may open and close the auxiliary cover 90 smoothly.

The auxiliary cover 90 will be described in detail later.

As follows, in reference to FIGS. 4*a* to 6, a configuration and an operating method of the food container will be described in detail.

Figure 4A:
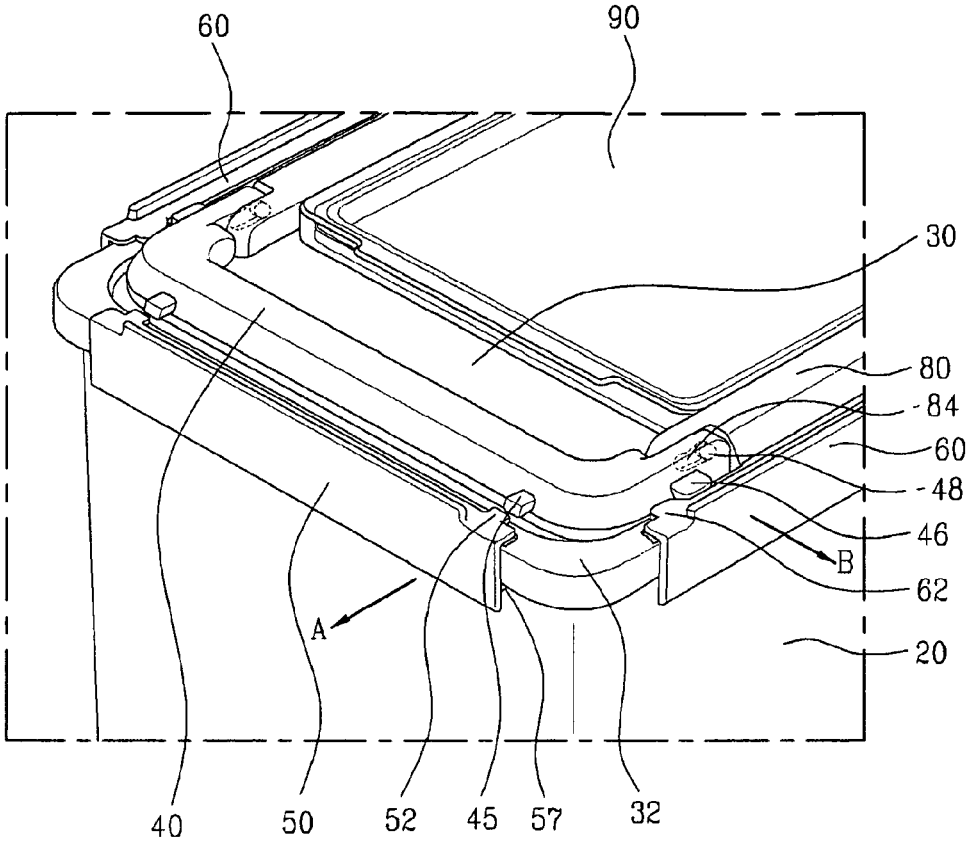
FIG. 4*a* is a partially enlarged perspective view of a side of the food container shown in FIG. 1.
Figure 4B:
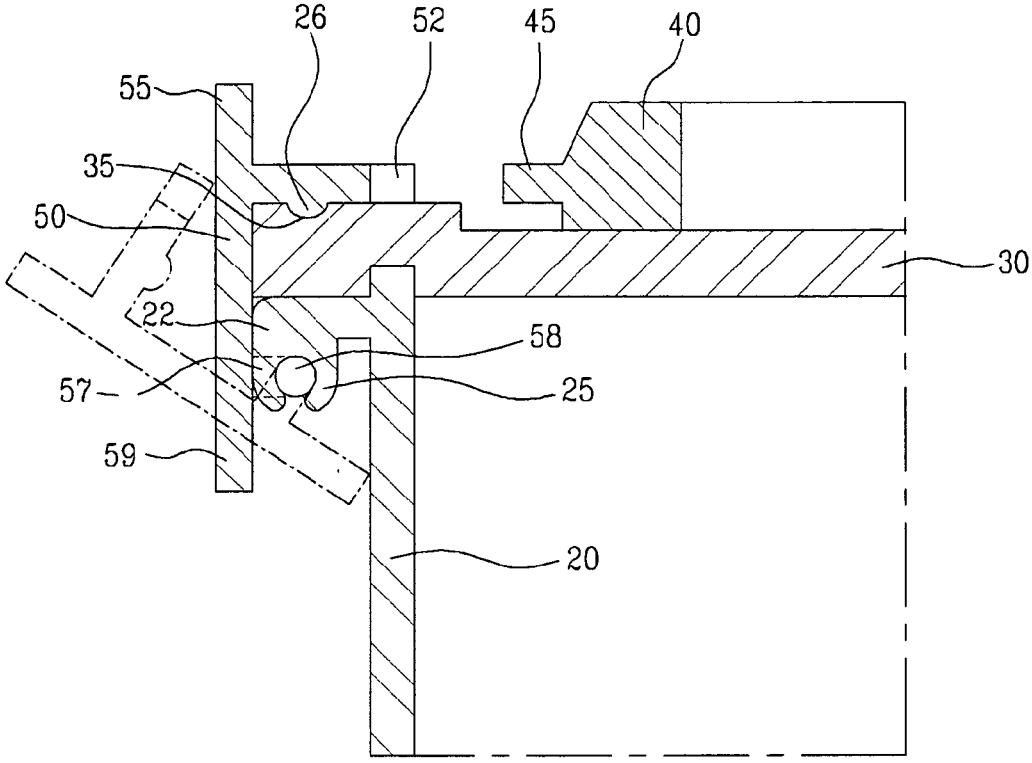
FIG. 4*b* is a partially cut-away sectional view of a projecting part of a handle and a projection of a securing member, with respect to a plane passing the projecting part and the projection.
Figure 5:
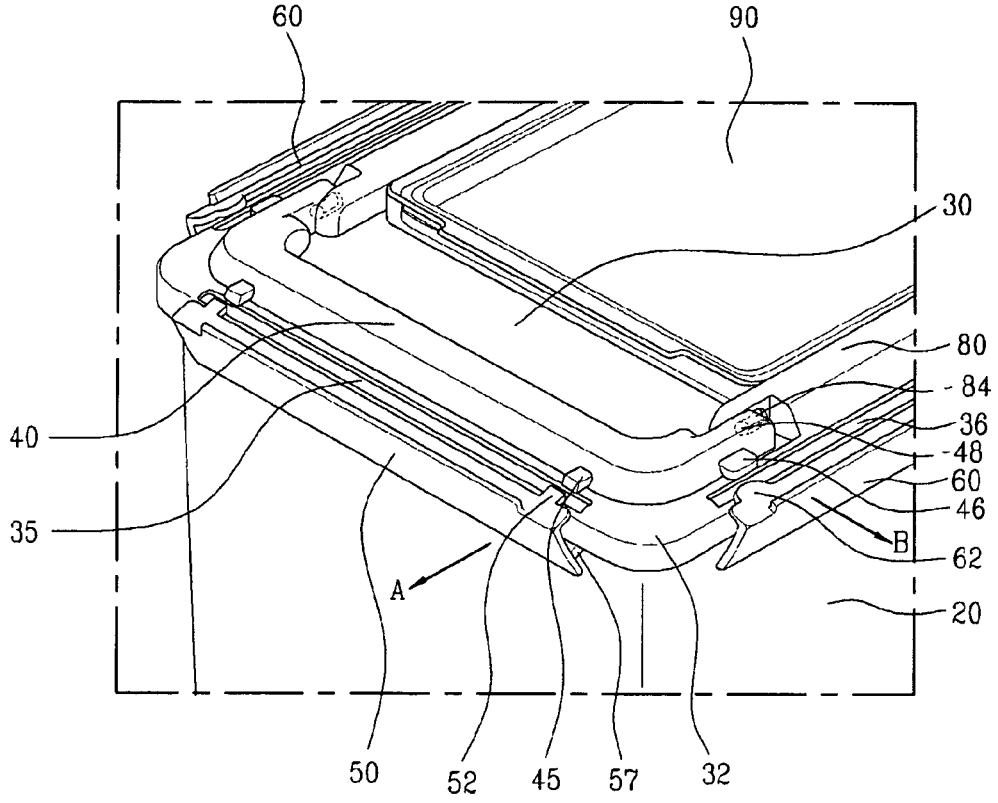
FIG. 5 is a perspective view illustrating a plurality of securing members which are separated from the food container of FIG. 4*a* by the projecting part provided in the handle.
Figure 6:
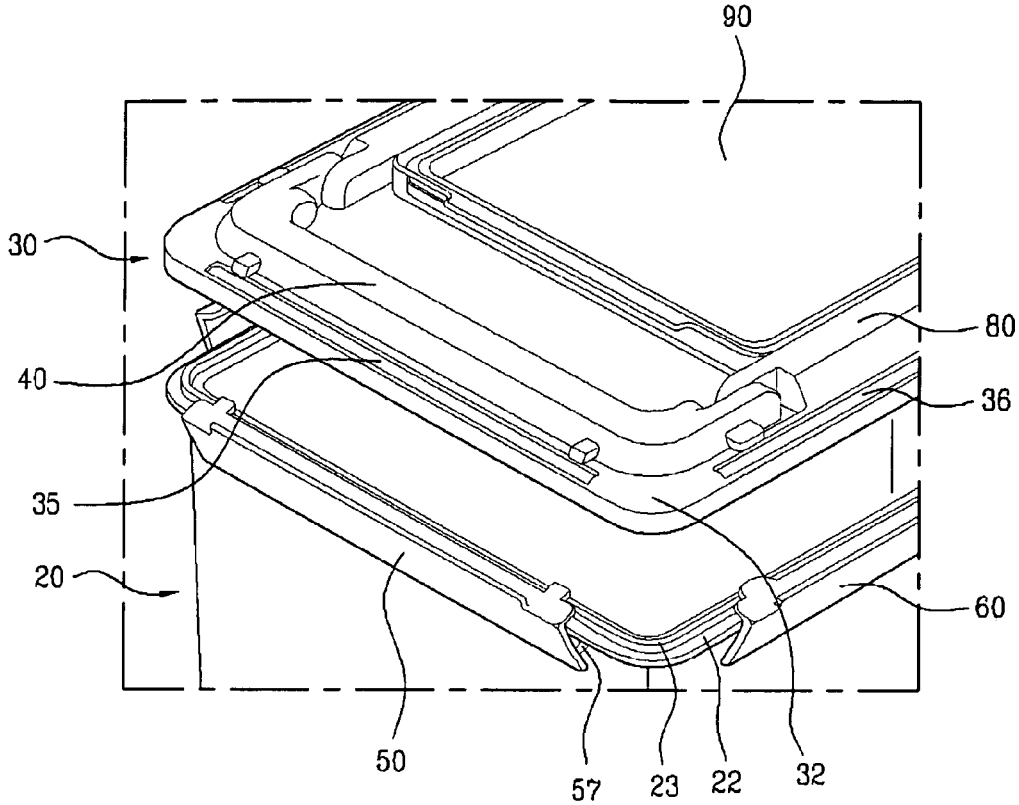
FIG. 6 is a perspective view illustrating a cover which is separated from a main body in a state of FIG. 5.

FIG. 4*a* is a partially enlarged perspective view of a side of the food container shown in FIG. 1. FIG. 4*b* is a partially cut-away sectional view of a projecting part of a handle and a projection of a securing member, with respect to a plane passing the projecting part and the projection. FIG. 5 is a perspective view illustrating a plurality of securing members which are separated from the food container of FIG. 4*a* by the projecting part provided in the handle. FIG. 6 is a perspective view illustrating a cover which is separated from a main body in a state of FIG. 5.

In reference to FIG. 6, an edge part 22 is formed in an upper end of the main body 20 to heat the cover 30 thereon and this edge part 22 is projected more outward from an outer side surface of the main body 20.

A projecting part 23 is projected upward from a top surface of the edge part 22 and the projecting part is coupled to a bottom surface of the edge part 32 of the cover 30, to maintain airtightness of the food container.

As shown in FIGS. 4*a* and 4*b*, a hinge extending part 57 is integrally formed with each of the first side securing members 50 and the hinge extending part 57 is extended from an inner bottom surface of each first side securing member 50. A hinge shaft 58 is formed in an end of the hinge extending part 57.

A hinge shaft coupling part 25 is projected downward from a bottom surface of the edge part 22 formed in the main body 20.

The hinge shaft 58 is rotatably and insertedly coupled to the hinge shaft coupling part 25.

Together with that, a hinge shaft is integrally formed with each of the second side securing members 60, although not shown in the drawings. The hinge shaft of the second side securing member 60 may be rotatably coupled to a hinge shaft coupling part (26, see FIG. 7) formed in a corresponding location of a bottom surface of the edge part 32 formed in the cover 30.

FIG. 4*a* illustrates the securing members 50 and 60 which are securing the cover 30 to the main body 20 as shown in FIGS. 1 and 2. At this time, the handle 40 is in close contact with a top surface of the cover 30 and the rotation shaft 48 of the handle 40 is located in the innermost position of the shaft hole 84.

As shown in FIG. 4*b*, the hinge shaft 58 of the securing member 50 is rotatably inserted in the hinge shaft coupling part 25 formed in the bottom surface of the edge part 22 formed in the main body 20.

As shown in FIG. 5, grooves 35 and 36 are formed in predetermined portions of the top surface of the edge part 32 formed in the cover 30, toward the first and second sides, respectively. Corresponding to the grooves 35 and 36, projections or ribs 56 are formed in upper portions of bottom surfaces of the securing members 50 and 60, respectively. Here, the projection or rib of the second side securing member 60 is not shown in the drawings.

Because of that, the projections or ribs are inserted in the grooves 35 and 36 only to stabilize the securing force between the cover 30 and the main body 20, when the securing members 50 and 60 are securing the cover 30 to the main body 20.

FIG. 5 illustrates the securing members 50 and 60 which are separated from the cover 30 by the user's sliding of the handles 40 from the top surface of the cover 30 in both directions. In other words, when the projected parts 45 and 46 of the handle 40 are moved along 'A' direction as shown in FIG. 4*a*, the projection 52 of the first side securing member 50 is rotated along 'A' direction and the projection 62 of the second side securing member 60 is rotated along 'B' direction.

As shown in FIG. 5, the rotation shaft 48 of the handle 40 is located in an outermost position of the shaft hole 84.

As shown in FIGS. 4*a* and 4*b*, lower end corners of the securing members 50 and 60 may be extended more downward than the hinge shaft (58, in case of the first side securing member) of the securing member 50 and 60. The downwardly extended portion from the lower end of the first side securing member 50 is referenced to as '59'.

As shown in a dotted line of FIG. 4*b*, a lower end of the extended portion 59 is supported by a side surface of the main body 20 in contact, when the securing member 50 is rotated. When the lower end of the extended portion 59 contacts with the side surface of the main body 20, the securing member 50 is not rotated any further. Because of that, the rotational angle of the securing member 50 is limited.

The length of the extended portion 59 may be adjustable appropriately enough to limit the rotational angle of the securing member 50 in a predetermined range according to a relative distance among the securing member 50, the hinge shaft 58 and the side surface of the main body 20. The configuration for limiting the rotational angle in the predetermined range is applicable to the second side securing member 60 identically.

As a result, even when the food container according to the present invention is installed in a storage chamber inside a drawer compartment of the refrigerator, the user may open the securing members 50 and 60 to separate the cover 30. The rotational angle of the securing members 50 and 60 has to be enough to separate the cover 30 from the main body 20.

When the securing members 50 and 60 are separated from the cover 30 to be rotated as shown in FIG. 5, lower end corners of the securing members 50 and 60 supportedly contact with the side surface of the main body 20. Because of that, each of the securing members 50 and 60 is rotated as much as possible as shown in FIG. 5. Seen from the top surface thereof as shown in FIG. 3, the securing members 50 and 60 may be distant enough to lift and separate the cover 30.

As shown in FIG. 6, when the securing members 50 and 60 are separated to be rotated from the cover 30, the cover 30 may be lifted from the main body 20. Of course, the user may hold and lift the edge part 32 and hold and lift the handle 40, when lifting the cover 30.

Figure 7:
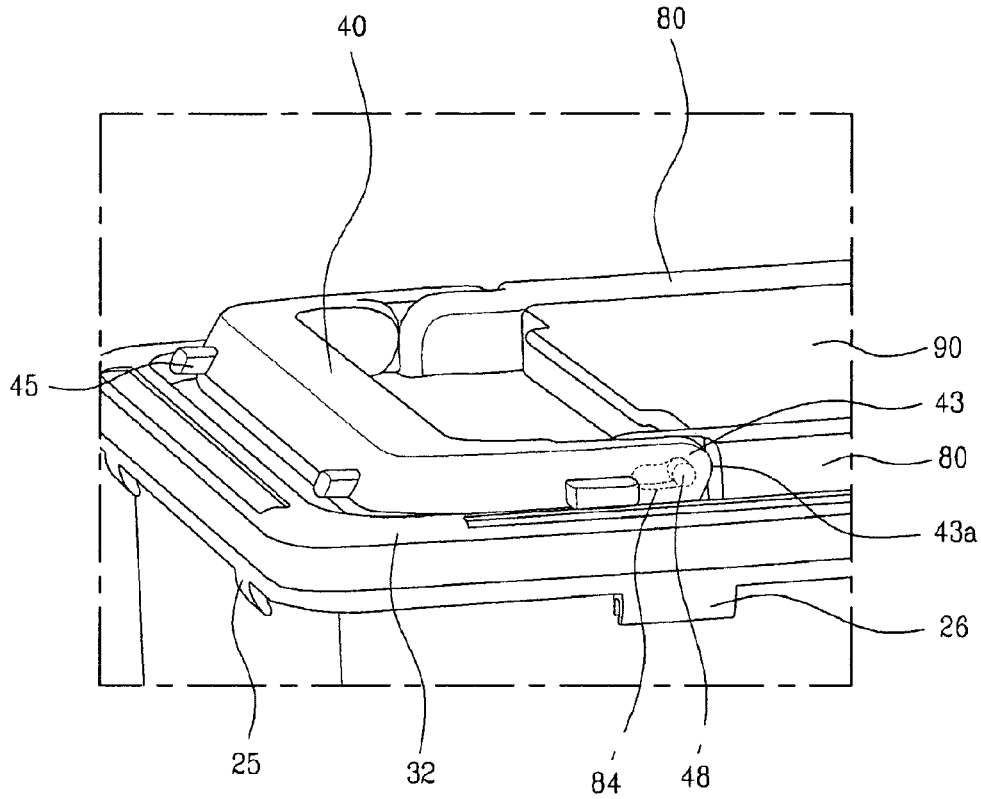
FIG. 7 is a perspective view illustrating the handle which is coupled to a handle coupling rib of the cover.
Figure 8:
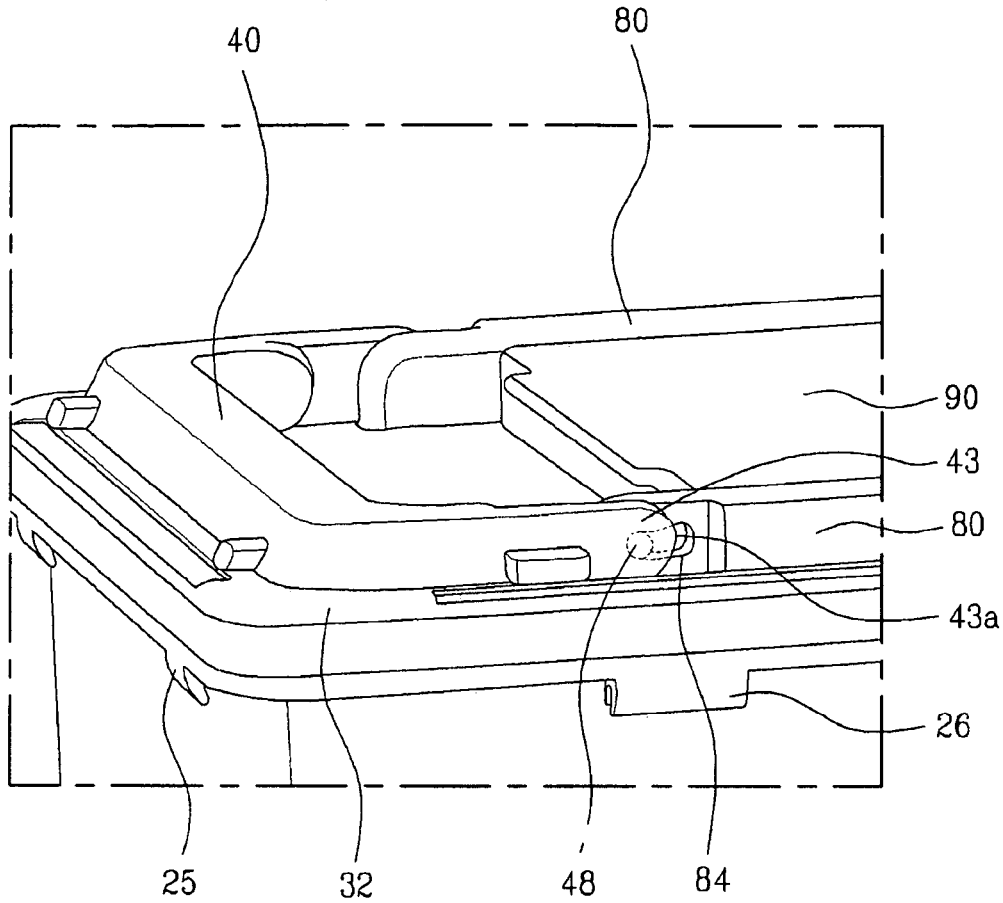
FIG. 8 is a perspective view illustrating the handle which is pushed outwardly in a state of FIG. 7.

According to FIGS. 7 and 8, plurality of securing members 70 are separated from the main body 20 and they are not shown for convenience sake.

The hinge shaft 58 of each of the pair of the first side securing members 50 may be inserted in a first side hinge shaft coupling part 25 of the main body 20. Also, the hinge shaft of each of the pair of the second side securing members 60 may be inserted in the second side hinge shaft coupling part 26.

As shown in FIGS. 7 and 8, both ends of the handle coupling rib 80 are cut away outwardly with respect to the second side of the cover 30 and the thickness of the ends is halved. Here, the long-hole-shaped shaft hole 84 is formed on the top surface of the cover 30 in parallel.

The handle 40 is formed in an overall '⊏' shape and the rotation shaft 48 is projected inward to both opposite ends of the handle 40. The portion of the handle 40 where the rotation shaft 48 is formed, in other words, the inner portions of both opposite ends of the '⊏'-shaped handle 40 may be cut away to halve its thickness, corresponding to the cut-away portion of both ends of the handle coupling rib 80.

This pair of the rotation shafts 48 may be inserted in the shaft holes 84 formed in the ends of the pair of the handle coupling ribs 80, respectively.

The rotation shaft 48 of the handle 40 is able to slide and rotate in a right-and-left direction inside the shaft hole 84.

Also, the size of the shaft hole 84 may be getting larger gradually toward the center of the cover 30.

The handle 40 is able to slide and rotate on the top surface of the cover 30 simultaneously. Because of that, when the user lifts the food container 10, holding the handles 40, it should be secured not to open the cover 30.

The appearance of the shaft hole 84 and the appearance of each outer circumferential surface of both opposite ends 43 of the handle may allow the cover 30 to be lifted without being open, when the handle 40 is rotated and held.

The structure and operation related to this will be described in detail as follows.

In reference to FIGS. 7 to 10, the sliding and rotating of the handle 40 will be described. According to FIGS. 7 to 10, the auxiliary cover 70 is separated and not shown for convenience sake.

As shown in FIG. 7, the rotation shaft 48 of the handle 40 is inserted in the long-hole-shaped shaft hole 84. Especially, the rotation shafts 48 are insertedly coupled to the left ones of the long-hole-shaped shaft holes 84 formed in the opposite ends of the pair of the handle coupling rib 80, in close contact rightward.

FIG. 8 illustrates the handle 40 which is pushed leftward in the state of FIG. 7. Here, the rotation shaft 48 of the handle 40 is located in close contact with the long-hole-shaped shaft hole 84 leftward.

Here, the size of the shaft hole 84 is getting larger gradually toward the center of the cover 30.

Together with that, an outer circumferential surface of each opposite end 43 of the handle 40 may be formed to be a curved surface having a variable radius of curvature, not a circular arc surface having an identical diameter from the center of the rotation shaft 48. In other words, the outer circumferential surface of each opposite end of the handle 40 has a point which is the farthest from the center of the rotation shaft 48 and this point will be referenced to as 'farthest point 43'. The distance from the center of the rotation shaft 48 to the farthest point 43*a* may be larger than the distance from the center of the rotation shaft 48 to the top surface of the cover 30.

Figure 9:
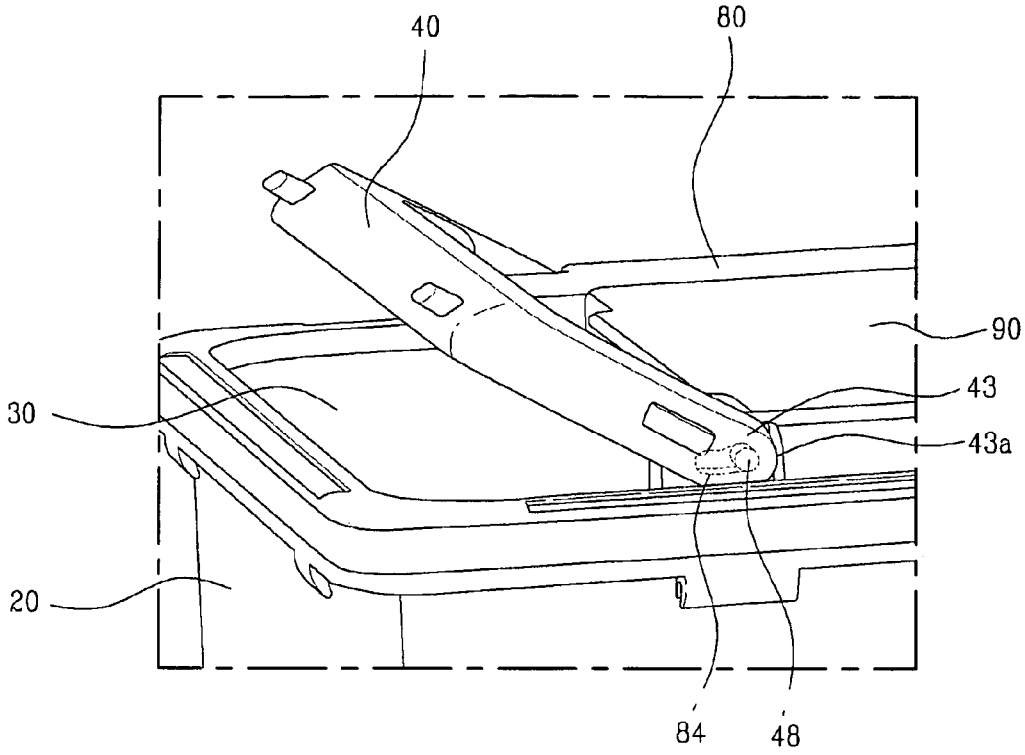
FIG. 9 is a perspective view illustrating the handle which is rotated at a predetermined angle in a state of FIG. 7.

FIG. 9 illustrates the handle 40 which is rotated at an acute angle from the state of FIG. 7. Even in this state, the rotation shaft 48 located in the right portion of the shaft hole 84 maintains the close contact with the right lower portion of the shaft hole 84 as shown in FIG. 7.

When the handle 40 is further rotated to be close to 90°, the rotation shaft 48 is lifted upward from the right portion, which has the largest size in the shaft hole 84, naturally until the farthest point 43*a* of the handle 40 contacts with the top surface of the cover 30.

Figure 10:
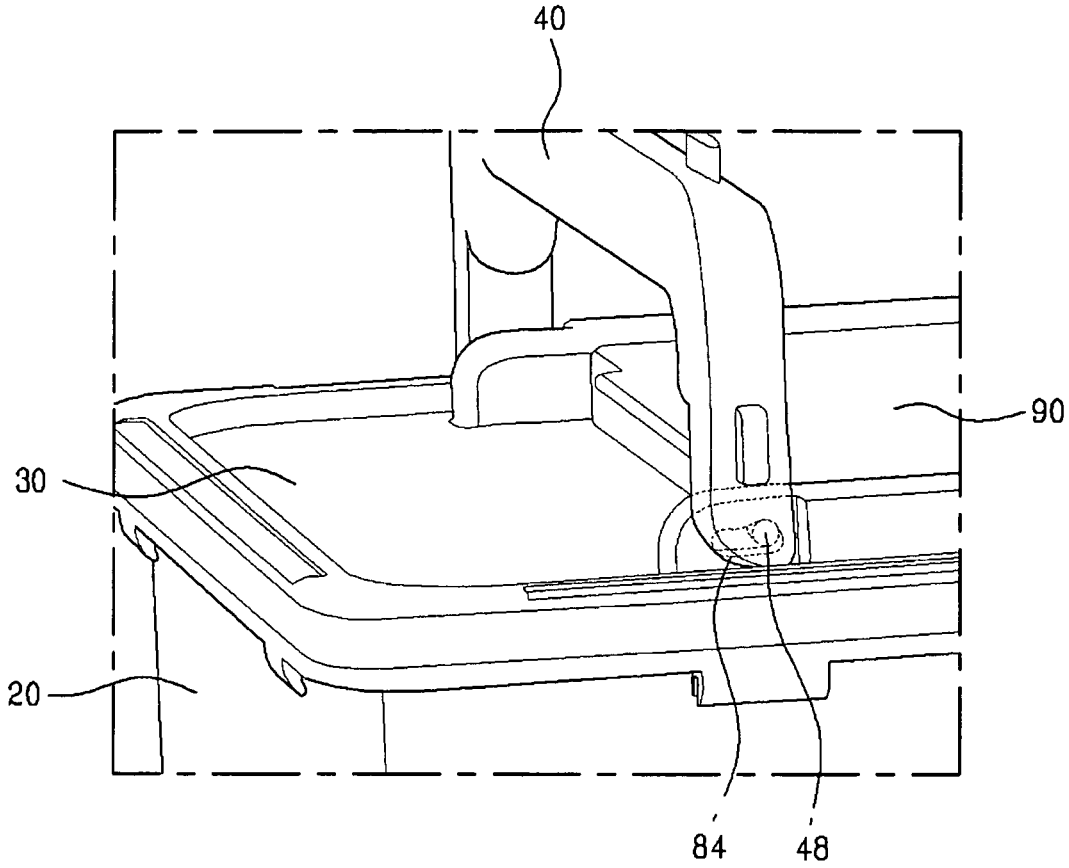
FIG. 10 is a perspective view illustrating the handle which is further rotated in the state of FIG. 9, to be perpendicular.

As a result, when the handle 40 is rotated at the angle of 90°, the rotation shaft 48 is located in close contact with a right upper portion of the shaft hole 84 as shown in FIG. 10. When the user lifts the handle 40 in this state, the rotation shaft 48 is in close contact with a right upper end surface of the shaft hole 84. At this time, the user may lift the cover 30 having the handles 40 connected thereto and the main body 20 secured by the securing members 50 and 60 connected with the cover 30, in other words, the entire portion of the food container 10.

As described above, as the long-hole-shaped shaft hole 84 is getting farther from the first side of the cover 30, the size, especially, the vertical direction height of the shaft hole 84 is getting larger. Because of that, the cover 30 is prevented from separating, which might occur because the securing members 50 and 60 are separated by the handles 40 without intension when the user rotating the handles 40.

Especially, when the user rotates the handles 40 in a state of the rotation shafts 48 of the handles 40 are not in close contact with the right portion of the shaft hole 84 as shown in FIG. 7, the rotation shafts 48 will be moved rightward and upward naturally according to the appearance of the outer circumferential surfaces of the ends 43 while the handles 40 are rotated.

In addition, when the user lifts the food container 10, with holding the handles 40, the rotation shafts 48 of the handles 40 may be prevented from sliding inside the long-hole-shaped shaft holes 84.

In reference to FIG. 11, the process of the user's lifting of the food container 10 with holding the handles 40 will be described in detail.

Figure 11:
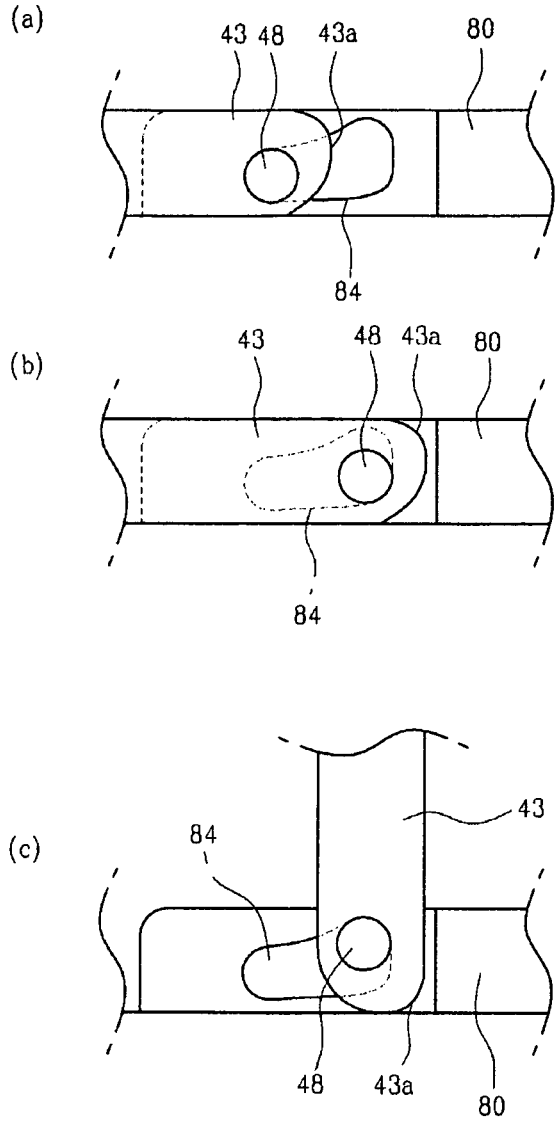
FIG. 11 is a side sectional view sequentially illustrating the handle which is sliding rotated to be perpendicular in a state of a shaft of the handle being coupled to a shaft hole of the handle coupling rib.

FIG. 11 is a side sectional view illustrating the process of the handles 40 being rotated perpendicularly and lifted from the state of the rotation shafts 48 of the handles 40 located in the left portion of the shaft holes 84.

According to FIG. 11(*a*), the rotation shaft 48 of the handle 40 is located in the left portion of the shaft hole 84. In this state, the connection between the securing members 50 and 60 and the cover 30 is unlocked.

After that, the user secures the securing members 50 and 60 to the cover 30 and he or she is sliding the handles 40 rightward, to be a state shown in FIG. 11(*b*).

Hence, when the user rotates the handles 40 perpendicularly, the outer circumferential surface of the ends 43 of the rotation shafts 48 are lifted naturally, with being supported by the top surface of the cover 30, only to be in contact with the right upper end surface of the shaft hole 84. This state is shown in FIG. 11(*c*).

According to the food container of the present invention, the user spreads the handles, which is able to slide on the cover of the food container, in both opposite directions and then he/she may separate the plurality of the securing members simultaneously. Because of that, the user may use the food container according to the present invention very conveniently.

In the meanwhile, a food container 10 used for a Kimchi refrigerator may further include an opening 38 formed in a center of the cover 30 and an auxiliary cover 90 for closing the opening of the cover.

Figure 12:
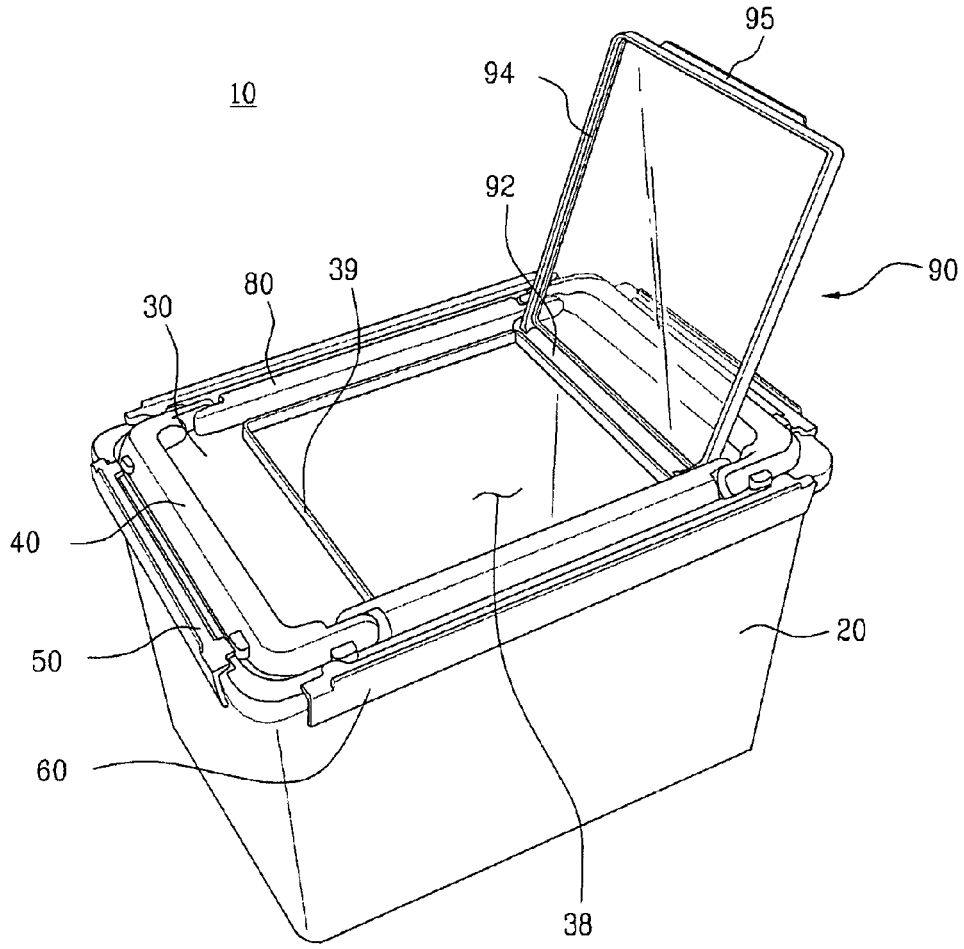
FIG. 12 is a perspective view illustrating an auxiliary cover which is open in the food container.

As shown in FIG. 12, the opening 38 is formed in the center of the cover 30 and this opening 38 may be rectangular-shaped according to the appearance of the cover 30. However, the opening may be formed in difference shapes. The opening 38 is formed between the pair of the opposed handle-coupling-ribs 80.

The opening 38 of the cover 30 is opened and closed by the auxiliary cover 90.

The auxiliary cover 90 may be rotatable about a shaft of a hinge (91, see FIG. 12) provided in a position distant from the first side cover of the main body 20.

The hinge 91 may be inserted in holes formed in inner surfaces of the pair of the handle coupling ribs 80, facing each other. Likewise, the handles 40 and the hinges 91 of the auxiliary cover 90 may be coupled to the handle coupling ribs 80. Further ribs to which the hinges 91 are coupled may be formed on the top surface of the cover 30.

The hinge 91 of the auxiliary cover 90 is coupled to an inner side surface of the handle coupling rib 80. The rotation shaft 48 of the handle 40 is coupled to an outer side surface of the handle coupling rib 80.

Figure 13:
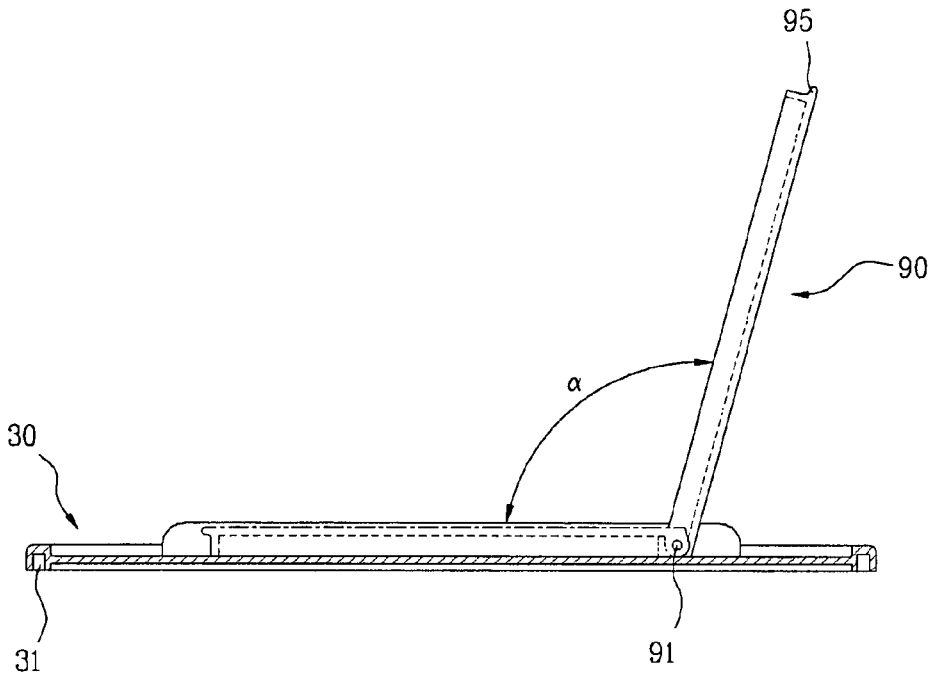
FIG. 13 is a side sectional view illustrating a process of the closed auxiliary cover being open at the maximum angle in the food container.
Figure 14:
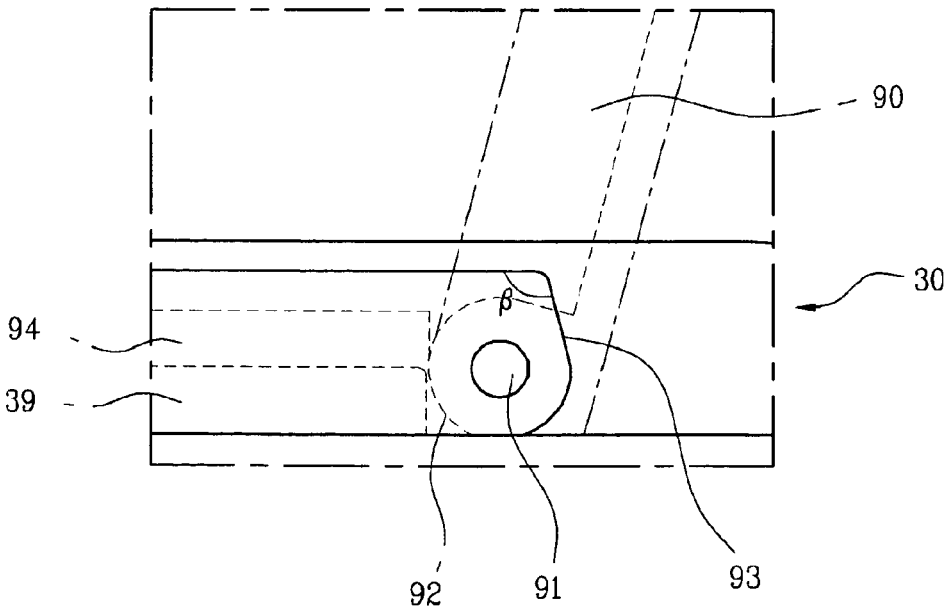
FIG. 14 is an enlarged side sectional view illustrating a hinge part of the auxiliary cover shown in FIG. 13.

FIG. 13 illustrates a process of the auxiliary cover 90 being opened at the maximum angle from a state of being closed with respect to the cover 30. FIG. 14 enlarges the hinge 91 of the auxiliary cover 90, illustrating a full line and a dotted line to show the closed state and the opened state at the maximum angle of the auxiliary cover 90, respectively.

As shown in FIG. 13, the auxiliary cover 90 is rotated about the hinge 91 with respect to the cover 30 and the maximum open angle ($\alpha$) is in a range of 100°~110°.

For that, the auxiliary cover 90 may further include a slope surface 93 formed in the side surface where the hinge 91 is located.

The slope surface 93 of the auxiliary cover 90 may form a predetermined angle of 100°~110°.

An angle ($\beta$) formed by the slope surface 93 formed in the side surface of the hinge 91 of the auxiliary cover 90 and the top surface of the auxiliary cover 90 may be in a rage of 100°~110°. In other words, the maximum opened angle ($\alpha$) of the auxiliary cover 90 is determined by the angle ($\beta$) formed by the slope surface 93 and the top surface of the auxiliary cover 90. The angle ($\beta$) of the slope surface is in the range of 100°~110°.

According to FIG. 14, when the auxiliary cover 90 is opened at the maximum angle, the slope surface 93 is supported in contact with the top surface of the cover 30. Since the auxiliary cover 90 is opened at 100° or more, the auxiliary cover 90 may not closed by the center of the gravity naturally, without touching the auxiliary cover.

In addition, the moment of the auxiliary cover 90 opened at the maximum angle of 110° with respect to the hinge 91 is not so much and the area of the slope surface 93 is secured enough. Because of that, the slope surface 93 may support the maximum opened auxiliary cover 90 enough.

Back to FIG. 12, a projecting part 39 projected upward is formed in an edge of the opening 38 and a groove 94 may be formed in an edge part of the auxiliary cover 90 to allow the projecting part 39 inserted therein, when the auxiliary cover is closed.

The opening 38 of the auxiliary cover 90 may be provided in the center of the cover 30 between the handle coupling ribs 80, in a rectangular shape. An edge of the opening 38 toward the handle coupling ribs 80 has a predetermined distance with respect to the handle coupling ribs 80.

The projecting parts 39 are projected upward from four sides of the opening 38, with a predetermined thickness and height.

Grooves 94 are formed in a bottom surface of the edge of the auxiliary cover 90 to insert the projecting parts 39 therein.

The width of each groove 94 is minutely larger than the thickness of the projecting part 39 and the depth of the groove 94 may be identical to the height of the projecting part. Because of that, the airtigntness between the cover 30 and the auxiliary cover 90 is enhanced and cold air is prevented from leaking, when the auxiliary cover 90 is closed.

In the meanwhile, a circular arc surface 92 having a regular radius of curvature with respect to the center of the hinge 91 is formed in a bottom surface of the corner having the shaft of the hinge 91 located therein. As a result, when the auxiliary cover 90 is rotated, the airtightness may be improved without interfering with the projecting parts 39.

The auxiliary cover 90 may be formed of a transparent material.

The main body 20 of the food container 10 is typically formed of opaque plastic material and it may be formed of transparent material.

Especially, in case the food container 10 according to the present invention is configured to store Kimchi having kimchi liquid and the like, the food container 10 may be typically formed of opaque plastic material. At this time, it is inconvenient to identify the kind and state of food stored in the food container after opening the cover.

As a result, the main body 20 and the cover 30 are formed of opaque material and the auxiliary cover 90 is formed of transparent material according to this embodiment. Because of that, contents contained in the food container may be identified, without opening the cover.

Also, the auxiliary cover 90 may further include handle part 95 provided in an edge portion in opposite to the hinge 91.

As shown in FIGS. 12 and 13, the handle part 95 of the auxiliary cover 90 is projected sideward from a side surface of the auxiliary cover 90 in opposite to the hinge 91.

A top surface of the handle part 95 may correspond with the top surface of the auxiliary cover 90. Of course, the top surface of the handle part 95 may be partially or upwardly projected from the top surface of the auxiliary cover 90.

A refrigerator 100 according to the present invention includes a cabinet 110 having a storage chamber formed therein, a door for opening and closing a front surface of the cabinet 110, a drawer compartment 140 retractably provided in the cabinet 110, and a food container. The food container includes a main body 20 having a food entrance formed on a topside, a cover 30 for opening and closing the entrance of the main body 20, with an opening 38 formed in a center thereof, a securing member 70 for securing the cover 30 to the main body 20, and an auxiliary cover 90 rotatably coupled to a rear portion of the opening of the cover 30 to open and close the opening 38.

Figure 15:
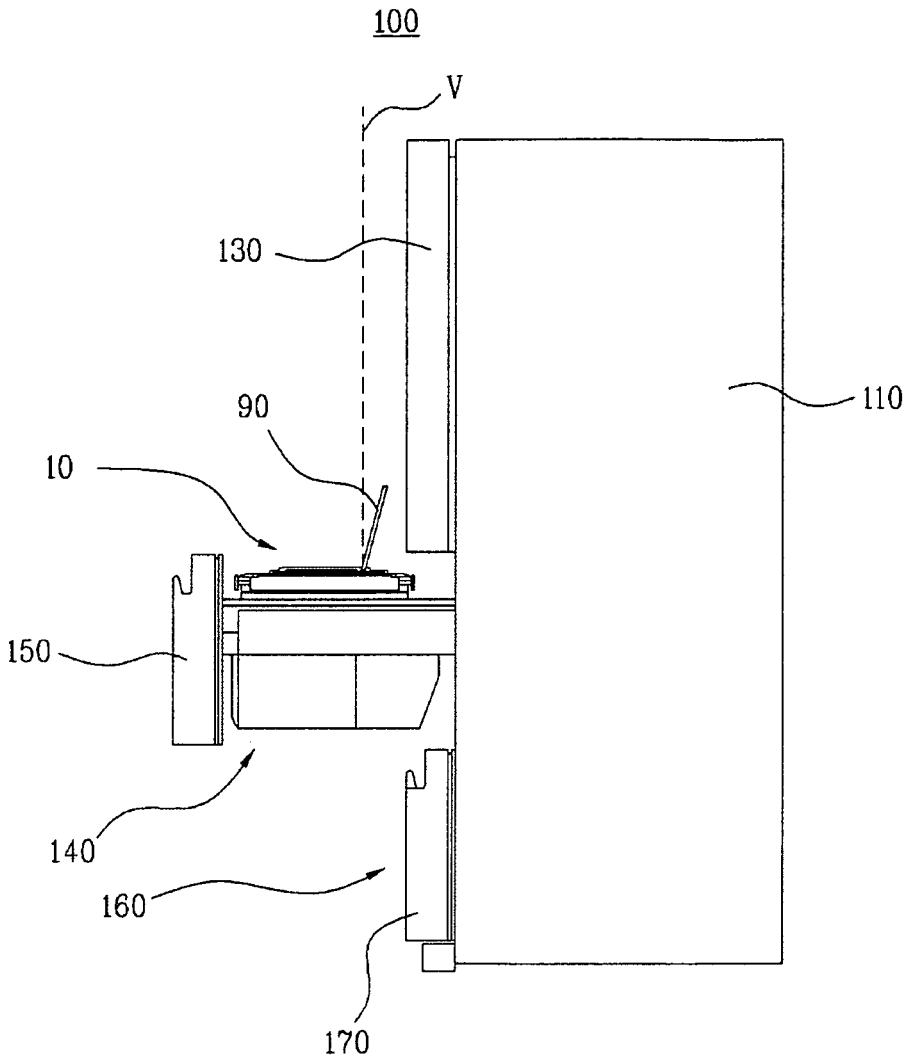
FIG. 15 is a side sectional view illustrating an open state of the auxiliary cover provided in the food container after drawing out a draw compartment from a refrigerator including the food container.

FIG. 15 is a side sectional view schematically illustrating the open auxiliary cover 90 of the food container 10 after drawing a middle drawer compartment 140 from the refrigerator 100 including the food container 100 according to the present invention.

As shown in FIG. 15, the refrigerator 100 according to the present invention includes the food container 10. This food container 10 is installed in the drawer compartment 140 retractably provided in the cabinet 110 of the refrigerator.

The door 130 rotated by a hinge installed in an upper portion thereof is coupled to the refrigerator according to this embodiment. A middle drawer compartment 140 and a bottom drawer compartment 160 are provided below the door 130.

The food container 100 installed in the middle drawer compartment 140 is applicable in case the refrigerator 100 is a Kimchi refrigerator and the present invention is not limited thereto. It is obvious that the food container 10 can be installed in the bottom drawer compartment 160. Even in case of a typical refrigerator, a predetermined portion of a refrigerating compartment or freezing compartment may be configured of a drawer compartment or configured to be closed by a rotatable door. Even in this case, the food container may be provided in the storage chamber.

Doors 150 and 170 are coupled to front surfaces of the middle and bottom drawer compartments 140 and 160, respectively. Typically, the drawer compartments 140 and 160 may be retractably supported by guide rails provided in both side surfaces thereof.

The configuration of the food container 10 installed in the refrigerator 100 according to the present invention is identical to the description mentioned above and repeated description will be omitted accordingly. Here, a relation with the other components of the refrigerator will be described in case this food container 10 is used in the refrigerator 100.

As shown in FIG. 15, when the food container 100 is installed in the middle drawer compartment 140 of the refrigerator 100, a top surface of the food container 10 has to be lower than the door 150 of the middle drawer compartment. Otherwise, the drawer compartment 140 cannot be pushed backward in a state of the food container 10 installed therein.

In addition, when the drawer compartment 140 is moved outward only to open the auxiliary cover 90 of the food container 10 at the maximum angle, the hinge 91 of the auxiliary cover 90 may be located in front of the front surface of the door 130 located beyond the drawer compartment 140 and an upper end edge of the auxiliary cover 90 may not contact with the front surface of the door 130.

First of all, when the food container 10 is installed in the drawer compartment 140 or 160, the hinge 91 of the auxiliary cover 90 is connected to be located in a rear portion of the refrigerator 100 and after that the drawer compartment 140 or 160 is pushed backward. Two food containers 10 may be installed in the drawer compartment 140 or 160 in parallel.

When trying to take food out of the food container, the user pulls the drawer compartment door 150 to draw the middle drawer compartment 140 outward. At this time, the drawer compartment has to be drawn outward to the end to move the drawer compartment as outward as possible.

Hence, the auxiliary cover 90 of the food container 10 is opened at the maximum angle to be the state shown in FIG. 14.

As shown in FIG. 15, drawing a virtual vertical line (V) passing the hinge 91 of the auxiliary cover 90, the vertical line (V) is spaced apart a predetermined distance from the front surface of the door 130 located above. Because of that, the upper end edge of the auxiliary cover 90 maintains the distant state not in contact with the front door of the door 130, even when the auxiliary cover 90 is opened at the maximum angle of 100°~110°.

Even in case the food container 10 according to the present invention is installed in the bottom drawer compartment 160, the food container 10 may be used without the upper end edge of the auxiliary cover not contacting with the front surface of the door 150 of the middle drawer compartment 140 when the auxiliary cover 90 is opened.

According to the refrigerator of the present invention, the drawer compartment is drawn outward and food may be taken out only by opening of the auxiliary cover easily opened by the hinge, without opening the cover or without taking out the food container. As a result, the user may use the food container conveniently.

Furthermore, the maximum open angle of the auxiliary cover is limited. As a result, the auxiliary cover may not interfere with and contact with the other components of the refrigerator.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A food container comprising:

a main body having an entrance formed on a topside thereof;

a cover opening and closing the entrance of the main body;

a plurality of securing members comprising one end rotatably secured to a side surface of the main body and the other end detachably connected with an edge part of the cover, to secure the cover to the main body selectively; and a handle sliding-movable on a top surface of the cover and contactable with the plurality of the securing members, to push the plurality of the securing members according to the sliding to unlock the securing between the cover and the main body, wherein a rotation shaft of the handle is coupled to an elongated shaft hole rotatably and slidingly in a horizontal direction, the shaft hole formed in parallel to a top surface of the cover, and wherein the handle comprises a plurality of projecting parts provided in side surfaces thereof to push the plurality of the securing members connected to the cover according to outward movement to separate the plurality of the securing members from the cover.

2. The food container of claim 1, wherein the plurality of the securing members comprise a plurality of projections formed at upper edges thereof to be pushed by the projecting parts of the handle, respectively.

3. The food container of claim 2, wherein the size of the shaft hole increases toward a center of the cover gradually.

4. The food container of claim 2, wherein the cover is configured of a rectangle having two first-sides and two second-sides, the plurality of the securing members comprises a pair of securing members coupled to first side edges of the cover and a pair of securing members coupled to second side edges of the cover, and a slope surface is formed in a predetermined portion of each projection of the pair of the securing members coupled to the second side edge part of the cover, the slope surface formed in the portion contacting with the projecting part of the handle.

5. The food container of claim 1, wherein a lower end edge part of each of the plurality of the securing members is more extended downward than a hinge shaft of the securing member.

6. The food container of claim 1, further comprising:

an opening formed in a center of the cover; and an auxiliary cover opening and closing the opening of the cover.

7. The food container of claim 6, wherein the auxiliary cover is rotatably coupled to a predetermined portion of the opening by a hinge.

8. The food container of claim 7, wherein the auxiliary cover comprises a slope surface formed in an outer surface of the portion having the hinge connected thereto.

9. The food container of claim 8, wherein the slope surface of the auxiliary cover forms an angle of 100° to 110° with respect to a top surface of the auxiliary cover.

10. The food container of claim 7, wherein the auxiliary cover further comprises a handle part provided in an opposite edge part of the auxiliary cover to the hinge.

11. The food container of claim 6, wherein a projecting part is formed projected upward from an edge part of the opening, and a groove is formed in an edge part of the auxiliary cover to insert the projecting part therein, when the auxiliary cover is closed.

12. The food container of claim 6, wherein the auxiliary cover is formed of transparent material.

13. A refrigerator comprising:

a cabinet comprising a storage chamber formed therein;

a door opening and closing a front surface of the cabinet;

a drawer compartment retractably provided in the cabinet; and a food container detachably installed in the storage chamber or the drawer compartment, the food container comprising:

a main body having an entrance formed on a topside;

a cover opening and closing the entrance of the main body, with an opening formed in a center of the cover;

a plurality of securing members securing the cover to the main body;

a pair of handles movably provided on a top surface of the cover; and a plurality of projecting parts provided in side surfaces of the handles to push the plurality of the securing members connected to the cover according to outward movement of the handles to separate the securing members.

14. The refrigerator of claim 13, wherein the plurality of the securing members are provided, with one end rotatably secured to a side surface of the main body and the other end detachably connected with an edge part of the cover to secure the cover to the main body.

15. The refrigerator of claim 13, wherein a hinge of the auxiliary cover provided in the food container is located in front of a front surface of a door beyond the drawer compartment, when the auxiliary cover of the food container is opened at a maximum angle after the drawer compartment is moved outward, and an upper edge of the auxiliary cover is not in contact with the front surface of the door when the auxiliary cover is opened.

16. The refrigerator of claim 13, wherein the food container further comprises an auxiliary cover rotatably coupled to a rear portion of the opening of the cover to open and close the opening.

* * * * *